US009198820B2

(12) United States Patent
Philipson

(10) Patent No.: US 9,198,820 B2
(45) Date of Patent: Dec. 1, 2015

(54) WEIGHTED-RESISTANCE CERVICAL EXERCISER AND MEDICAL REHABILITATION DEVICE

(76) Inventor: Alan S. Philipson, Davie, FL (US)

( * ) Notice: Subject to any disclaimer, the term of this patent is extended or adjusted under 35 U.S.C. 154(b) by 795 days.

(21) Appl. No.: 13/545,741

(22) Filed: Jul. 10, 2012

(65) Prior Publication Data

US 2014/0018711 A1 Jan. 16, 2014

(51) Int. Cl.

| | |
|---|---|
| ***A63B 21/00*** | (2006.01) |
| ***A63B 23/03*** | (2006.01) |
| ***A63B 23/025*** | (2006.01) |
| ***A63B 21/065*** | (2006.01) |
| ***A61H 1/00*** | (2006.01) |

(52) U.S. Cl.

CPC ..... *A61H 1/00* (2013.01); *A63B 21/065* (2013.01); *A63B 21/1407* (2013.01); *A63B 23/025* (2013.01); *A63B 23/03* (2013.01)

(58) Field of Classification Search

CPC .... A63B 21/06; A63B 21/068; A63B 23/025; A63B 23/03; A63B 21/065; A63B 21/1407; A61H 1/00

USPC ..... 128/207.11

See application file for complete search history.

(56) References Cited

U.S. PATENT DOCUMENTS

| | | | | |
|---|---|---|---|---|
| 2,051,366 | A * | 8/1936 | Catron | 482/10 |
| 2,855,202 | A * | 10/1958 | Kinne | 482/10 |
| 4,168,060 | A * | 9/1979 | Hohenfeldt | 482/10 |
| 5,162,027 | A | 11/1992 | Robinson | |
| 5,501,646 | A | 3/1996 | Miller | |
| 6,000,066 | A * | 12/1999 | Williams | 2/422 |
| 6,179,747 | B1 | 1/2001 | Kelley | |
| 7,047,971 | B2 * | 5/2006 | Ho et al. | 128/207.11 |
| 8,640,710 | B2 * | 2/2014 | Matthews | 128/889 |
| 2003/0073549 | A1 * | 4/2003 | Hatch | 482/92 |
| 2003/0228955 | A1 * | 12/2003 | Makofsky | 482/10 |
| 2004/0058780 | A1 * | 3/2004 | Edgeton | 482/10 |
| 2007/0042869 | A1 * | 2/2007 | Pettibon | 482/10 |
| 2009/0318268 | A1 * | 12/2009 | Rosenblum | 482/10 |
| 2010/0151997 | A1 * | 6/2010 | Campbell | 482/11 |
| 2010/0292051 | A1 * | 11/2010 | Benumof et al. | 482/10 |

OTHER PUBLICATIONS

The Pain Education Institute; Preventative measures include strengthening of the back and adopting good body techniques. X-plain Patient Education HP120105 1995-2011.

(Continued)

*Primary Examiner* — Loan H Thanh
*Assistant Examiner* — Sundhara Ganesan

(57) ABSTRACT

The present invention relates in general to neck and jaw exercising and rehabilitation and more in particular to a device encompassing a method or methodology for configuring the device for use in strengthening, toning the neck and jaw muscles by implementing a consistent means of isotonic resistance. The present invention includes a telescopic longitudinal "spine" consisting in two parts with means to lock in place as well as a chin brace or support each adjusting to meet the user's specific anatomical features. Further elements of the present application includes a fixed padded latitudinal forehead support as well a centralized weighted "receiver" just above the aforementioned forehead support which secures the source of weighted resistance. Securing the device is an adjustable elastic strap attached to the latitudinal forehead support which reduces lateral shifting and insuring a safe isotonic movement.

3 Claims, 3 Drawing Sheets

(56) References Cited

OTHER PUBLICATIONS

Anthony L. Komaroff, M.D. Editor in Chief; Edward Coburn, Publishing Director Neck and Shoulder Pain; Special Health Report; Copyright © 2012; pp. 3, 5,6 & 23, by Harvard Medical University. USA.

Denise Wang; Exercises to Improve Platysmal Muscle Banding Banding, (http://www.livestrong.com/article/402630-exercises-to-improve-platysmal-muscle-banding/)University of Maryland Division of Administrative Affairs, Department of Environmental Safety (http://www.des.umd.edu/os/erg/neck.html)Copyright 1996-2012.

Ian Kroes, MD, Kristin Weidenbach, Paul Lepp, PhD; New analysis reveals human mouth carries more germs than expected. Stanford Report, Dec. 8, 1999.

Mark Saracino, DC, Dacan; Chiropractic Neurology Research Brief; Issue Two; vol. Four. 6. Harrison et al. Evaluation of the assumptions used to derive an ideal normal cervical spine model. Journal Manipulative Physiological Therapeutics 1997; 20: 246-56.

* cited by examiner

WEIGHTED-RESISTANCE CERVICAL EXERCISER AND MEDICAL REHABILITATION DEVICE

BACKGROUND OF THE INVENTION

1. Field of the Invention

The Invention described and claimed herein relates to equipment and procedures used in neck and jaw exercising and rehabilitation and in particular, to a device encompassing a method or methodology for configuring same.

2. Description of Related Art

According to a report entitled How to Prevent Back Pain, "Back pain is the most common medical problem in the U.S. It is mostly caused by muscle spasms and degeneration of the disks in the spine. If not taken seriously, back pain can become very disabling". The report goes on to state, "back pain will affect most people at one time in their lives. Action can be taken to prevent back pain or postpone the degeneration of the spine and disks. Preventative measures include strengthening of the back and adopting good body techniques". X-plain Patient Education HP120105 1995-2011[1]

Aside from improving elasticity, blood flow, reducing pain and strengthening the affected region, the importance of exercising the neck to maintain a youthful appearance as well as improve posture and health has been studied in great detail by academics and physicians alike. One such article appeared in the prestigious and widely respected Harvard Health Publications on Neck and Shoulder Pain (2012) in which it clearly states that "there is mounting scientific evidence that specific exercises (for the neck) has shown to break long cycles of neck pain"[2]. Further, according to an article published by the University of Maryland Division of Administrative Affairs, Department of Environmental Safety and referenced in an article which appeared on livestrong.com, "movement promotes toning, so tilting your head slowly from side to side or front to back will exercise all of the muscles of the lower face, jaw and neck, engaging the platysma muscle group and leading to a firmer jaw line" (Exercises To Improve Platysmal Muscle Banding—Livestrong.com (2011)).[3]

While the concept of utilizing resistance training to tighten and tone a specific anatomical region is nothing new, the idea of implementing resistance training to improve the appearance and function of the neck and jaw has been illustrated in prior art with varying degrees of efficacy, safety and functionality. Due to the anatomical limitation to grasp, the neck is the most difficult group of muscles to effectively exercise. Unlike the biceps in the arms for example which you exercise by grasping a barbell or dumbbell with your hands, the face being circular with no effective means of attachment creates a problem when attempting to do resistance training of any kind. The only true means of grasping weighted resistance is by placing said weighted resistance attached to a mouth piece to be inserted in the user's mouth; however, this is extremely dangerous for a number of reasons. These include, soft pallet pain, dental implants, partial or full dentures and temporomandibular joint disorder (TMJD or TMD). Further according to an article published by Stanford University, "The human mouth is awash with bacteria" The report went on to say, "Researchers have now shown that more of these oral inhabitants exist than previously thought. Using a combination of old and new scientific methods to study a scraping of plaque from a healthy human mouth, the researchers found evidence of 37 unique bacteria that microbiologists had never before recorded". (New Analysis Reveals Human Mouth Carries More Germs Than Expected; Kristtin Weidenbach; Ian Kroes, MD; 1999).[4]

The next most logical method is to have the resistance coming up from under the chin as demonstrated in Miller (U.S. Pat. No. 5,501,646), however, as in the aforementioned scenario where the user bites down on the means of attachment, any device that is "spring-loaded" coming up from under the chin creates an equally dangerous scenario for the user. In Miller, utilizing an apparatus secured to the torso and placing a spring loaded mechanism (means of resistance) under the chin, the user standing erect would push down thus engaging the muscles of the neck and jaw. In addition to being cumbersome, this configuration raises a number of safety issues for the user. One likely scenario can occur when the chin wet with perspiration, becomes slippery causing the spring loaded pad to slip sending it upward striking the nose and causing injury. Additionally, because the subject is applying pressure by extending the jaw and chin from a standing or vertical position rather than supine as in the present application, the user does not benefit from a full ROM (range of motion). Medical professionals have long deferred to ROM to determine everything from patient flexibility to joint articulation.

According to an article published in the Chiropractor Neurology Research Brief, normal Cervical lordosis (cervical portion of the spine from the base C7 to the atlas or last vertebrae C1) if properly aligned, should maintain a "progressive 34 degrees and an ideal normal lordosis of 42 degrees"[5]. This bend reduces direct downward pressure on the disks reducing nerve impingement as well as deterioration of the disk themselves. In keeping with this physiological trait, when the subject is lying supine, the natural movement of the head as it rises and falls will follow this angle. This movement is referenced in FIGS. 4 and 5 of the present application illustrating the subject utilizing the current invention configured in the present application from the axonometric view following the aforementioned movement. This natural articulation differs from the applied principals expressed in Miller, as it allows the weight of the head to be displaced subtly as opposed to straight down. Additionally, from a physiological perspective, aside from best effectuating the desired musculature, standing erect as illustrated in Miller as opposed to supine can lead to nerve impingement associated with compressed discs. The idea of applying resistance while the user is supine as opposed to standing was addressed in Robinson (U.S. Pat. No. 5,162,027) in which, the author describes "a neck exerciser comprising a headband assembly with a plurality of releasable securing means of resistance located along the headband". While from a kinesthetic perspective, this is a vast improvement over Miller, the weights in Robinson are interspersed and are not localized as in the present application. By centralizing the means of resistance and so transferring that localized resistance down a single point of transference as in the present invention, the result is a more isolated and significant contraction of the desired anterior musculature. In physics, a fulcrum is a lever consisting of a beam or rigid rod pivoted at a fixed hinge to lift a weighted object. For the purpose of defining the geometric points, the fixed hinge or Z-axis would be the anterior musculature of the neck. Referencing FIG. 3 of the present application, the X-axis would be comprised of (1) the padded cross member and (18) the weighted resistance which resides in (19) the secure receiver. The Y-axis is comprised of (2) the telescopic spine and (12) the padded chin support. As illustrated in FIG. 5 of the present application, as the head descends, the weight (18) secured just above the forehead (19) is transferred down the telescopic spine (2) to the chin (12) resulting in the contraction. The theory of transference with regard to the current application was tested using electromyography and implementing standard scientific method. The results were extrapolated to population statistics taking into account experimental error. Electromyography recording via grounded electrodes was accomplished utilizing the sternocleidomastoid muscles on either side as negative electrode references and clavicle electrode placement as positive reference points. The base of the neck posterior, inferior to the hyoid and foramen magnum, respectively, was used for ground electrode placement. The subject, a male, aged 31, lying supine commenced lifting and lowering his head simulating the same kinesthetic movement described and illustrated in the present application (FIGS. 4 and 5) with no device just the weight of his head. The electromyographical base was set at 5.4 millivolts with a maximal exertion of 14.2 millivolts representing the baseline. The subject was then fitted with a functional prototype fashioned consistent with the preferred embodiment of the current application with 3.5 pounds of weight located in the receiver and completing the aforementioned steps as illustrated in FIGS. 4 and 5 of the current application. The maximal exertion, muscle involvement rose to 42.3 volts, indicating significant sternocleidomastoid muscle exertion. Improvements were made in Kelley (U.S. Pat. No. 6,179,747) however, just as in prior art, the device described is used standing erect and does not allow for a full range of motion as in the present application. As previously addressed in Robinson, the argument for exercising the anterior musculature of the neck from a supine rather than standing position with regards to increased range of motion (ROM) and decreased downward compression on the cervical spine had been addressed. Further, as illustrated in Kelley, the use of elastic bands while providing a source of isotonic resistance does not provide the consistent isotonic resistance found in traditional weights as in the current application. Kelley further describes a "flexible yet rigid headband as well as a neck band that fit around the neck, a chin cup which fits around and under the chin . . . . The resistance bands for the head are permanently connected to the head band and the chin cup". Referencing FIG. 2, the present invention is comprised of a rigid material with an adjustable spine (2) and adjustable chin brace (12) requiring only two adjustments to be universally adapted to either male or female, young or old users reducing the additional steps as in Kelley to achieve individual functionality. Further, the present application with the weight securely placed above the forehead removes the need to strap the device around the neck as in Kelley which can be both uncomfortable for the user as well as restrictive to the carotid artery. The carotid artery is an artery that supplies the head and neck with oxygenated blood; it divides in the neck to form the external and internal carotid arteries. By placing any restrictive apparatus whether rigid or flexible both adjectives which were used by Kelley to define the make-up of the device the results can be reduce blood flow and pose a danger to the wearer.

SUMMARY OF THE INVENTION

It is the general object of the present invention to provide an adjustable, self-contained exercise apparatus affixed and secured to the head and more specifically the face in which a centralized weighted component enough to provide an isotonic movement is present for exercising and strengthening the neck and lower jaw.

The present invention more particularly consists of a raised, adjustable, telescopic spine, chin support and headband which allows the device to be universally configured to fit the specific anatomical needs of the user. The present application is comprised of a fixed closed-cell foam lined forehead support with a headband to hold the device firmly against the user's head. Just above the forehead pad resides the "receiver" of the central means of resistance. Once the appropriate amount of resistance is selected and placed in the "receiver", the threaded screw or alternatively, a means to secure the weights would pass through or secure against the weight or weights and tightened down against the threaded underside. As each face is unique, the telescopic "spine" allows the device to be lengthened or shortened so that the adjustable chin support fits securely and comfortably under the users chin. Once the desired length is achieved where the forehead support rests just above the brow-line and the chin support is firmly placed against the chin, the user would tighten down the threaded screw which passes through the top of the vertical slide and the slot of the telescopic "spine" to the threaded nut on the underside of the device. Similarly to the preceding, at the base of the telescopic "spine" is the adjustable closed-cell foam chin support. When properly adjusted, the chin support should come to rest far enough from the front of the chin so that when the device is in use as illustrated in FIGS. 4 & 5, the weight is transferred down the axis of the spine and displaced to the underside of the chin affecting the desired musculature. Similar to the telescopic spine, the chin support is comprised of a threaded screw which passes through the vertical slot to the threaded nut and tightened down. The final step is to tighten the headband so that when in use, the device is firmly pressed against the forehead reducing lateral shifting.

OBJECTS AND ADVANTAGES

Accordingly, the objects and advantages of the present invention are:

1). to provide a neck and jaw exercise device that utilizes a consistent means of isotonic resistance.

2). to provide a neck exercise device which through its design does not restrict blood flow to the neck or head by specifying the target of the transference under the chin as opposed to around the neck.

3). to provide a neck exercise device which is worn by the user in the supine position allowing full range of motion (ROM) to tone the effective region of the neck and lower jaw line.

4). to provide an isotonic neck exercising device which allows the user to adjust the weight to meet their own specific fitness goals and abilities.

5). to provide a completely self-contained neck exercise device which targets the major and minor muscle groups including and not limited to: the sternocleidomastoid, scalene, platysma, sternohyoid, omohyoid, mylohyoid, scalene and stylohyoid.

6). to provide an exercise device which is safe and effective to use in toning the neck and lower jaw-line.

7). to provide a neck exerciser with multiple adjustment points on the spine, chin and headband to provide comfort, safety and uniformity for the user.

8). to provide a neck exercising device which is easy to use and easy to take on and off.

9). to provide a neck exercise device which is light weight, durable, efficient, intuitive and adaptable for the purpose of which it is designed.

10). to provide a neck exercising device which can be quickly configured to meet the individual specifications of the user.

11). to provide a neck exercising device with removable padding which can be changed to reduce the likelihood of dermatological problems such as acne.

BRIEF DESCRIPTION OF THE DRAWINGS

The accompanying drawings which form part of the specification illustrate the preferred embodiment of the invention and when taken with the detailed description which follows, serve to explain the principals and operation of the invention.

DETAILED DESCRIPTION OF THE INVENTION

Figure 1:
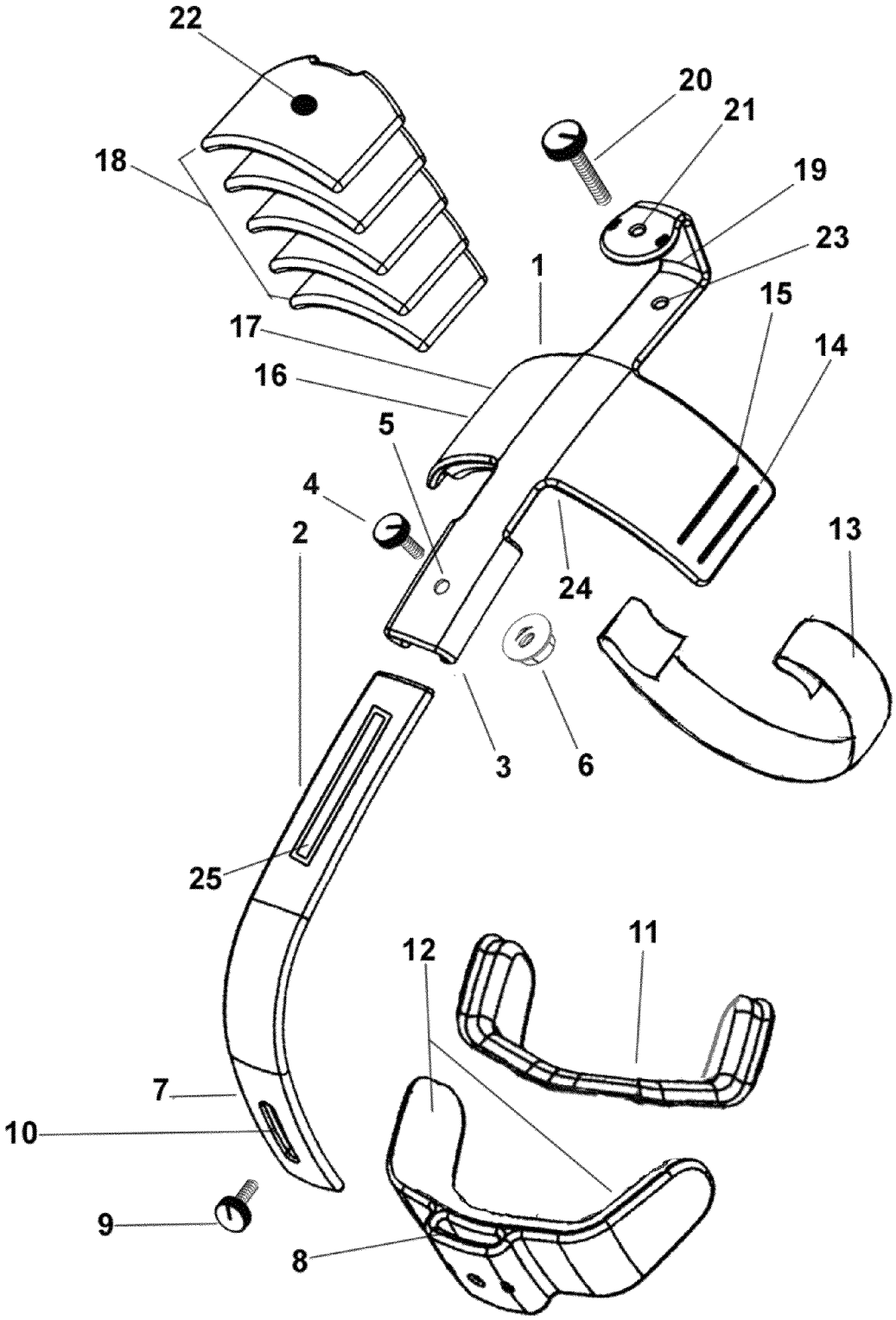
FIG. 1 illustrates an exploded view of a neck exerciser constructed in accordance with the present invention.
Figure 2:
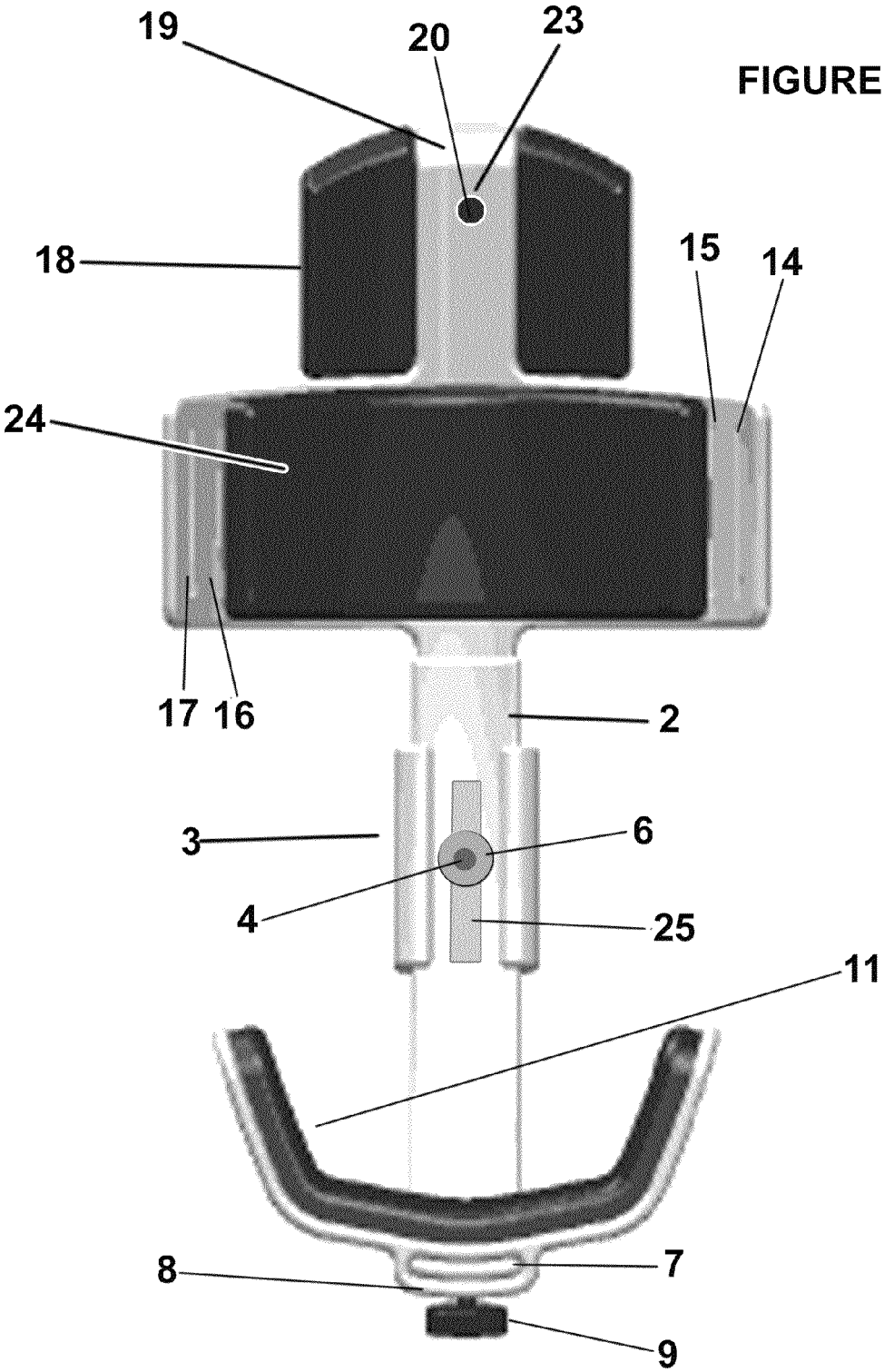
FIG. 2 illustrates a rear isometric view of the preferred embodiment of a neck exerciser configured in accordance with the present invention without the headband for clarity of the working components.

Referring to the figures, and particularly FIGS. 1 and 2, illustrates the preferred embodiment of the current invention with FIG. 2 illustrating a rear isometric view removing the headband which is illustrated in FIG. 1 (13) for the clarity of view of the articulating components. Referring to FIG. 1, the present invention is comprised of a rigid latitudinal cross member (1) with two longitudinal slats on either side (14, 15, 16 & 17) in which to pass the elastic headband (13) through with (14) and (16) having formed raised teeth in which to make contact with the fabric affixing the aforementioned band once adjusted to the user's desired fit. As referenced in the background of the invention, the human face primarily differs in length or as it is referred to in geometry as the "y axis". The "y axis" is the longitudinal line that runs from the forehead to the chin. To solve for this, referencing FIG. 1, the present invention consists of a longitudinal spine comprised in two main parts, a static receiver (3) which is permanently affixed to the latitudinal rigid cross member (1) and the articulating slide (2). To adjust, the user would turn the threaded screw (4), counter-clockwise. The aforementioned screw (4) passes through a hole (5) located atop the static portion of the slat receiver (3) and then through the longitudinal slot (25) located on the articulating portion of the spine (2) to a threaded washer-nut (6) on the underside of the static receiver (3). Once the screw turned counter clock-wise (4) is loosened, the articulating portion of the spine (2) will slide up or down and will be tightened once the appropriate vertical fit has been achieved. Referencing FIG. 1, the final articulating component to adjust will be the chin brace (12). Implementing similar steps to the aforementioned vertical adjustment, the user will want to adjust the padded (11) chin brace (12) so that when aligned properly as the head descends as illustrated in FIG. 4, the chin pad is far enough back that when weight transference occurs on the assent as illustrated in FIG. 5, that the chin brace (12) remains firm against the underside of the user's jaw.

Referencing FIG. 1, the aforementioned is accomplished by turning the threaded screw (9) which passes through the longitudinal slot (10) on the underside of the articulating spine (2) counter clockwise, this will allow the chin brace (12) to slide towards or away from the front to the rear of the chin. Once the adjustment is made, the user will turn the screw (9) clockwise tightening against the opposing threaded brace (12). Referencing FIG. 2, once the unit is properly adjusted to meet the specific anatomical specifications of the user, the padded cross-member (24, 1) will come to rest just above their brow-line, and the padded chin support (11, 12) will be securely below the chin. Referencing FIG. 1, the user would select the appropriate amount of weighted resistance (18) to meet their individual needs. Referring to FIG. 1, the weight (18) would be slid in the receiver (19) which is located just above the padded forehead support (24, 1). The weights (18) which can yield 0.5-1 lb of resistance each have a hole (22) which allows the threaded screw (20) to pass through the top (21) of the receiver (19) to the threaded base (23) below. Referencing FIG. 2, illustrates the present invention with the headband (13) removed to show a posterior isometric view of the device configured for use using the aforementioned steps.

Figure 3:
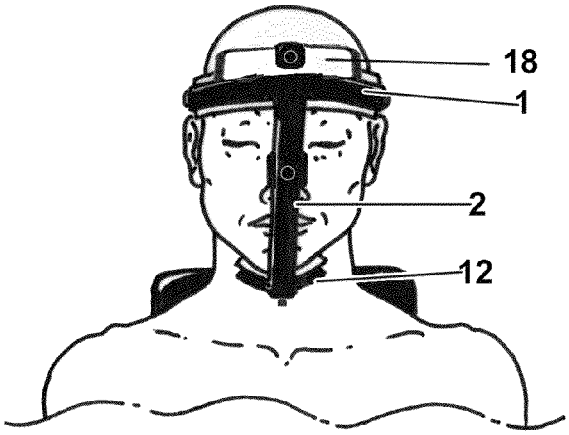
FIG. 3 illustrates a top view of the present invention being used in accordance to the configuration set forth in the detailed description of the invention.

Once the present invention is properly configured, the user would lay on their back (supine) on a raised, firm platform as illustrated in FIG. 3. Aligning the shoulders to the edge of the aforementioned surface, the head should now be free to rise and fall within the prescribed 45 degrees range of motion which can be increased or decreased depending on the physical ability of the user.

Figure 4:
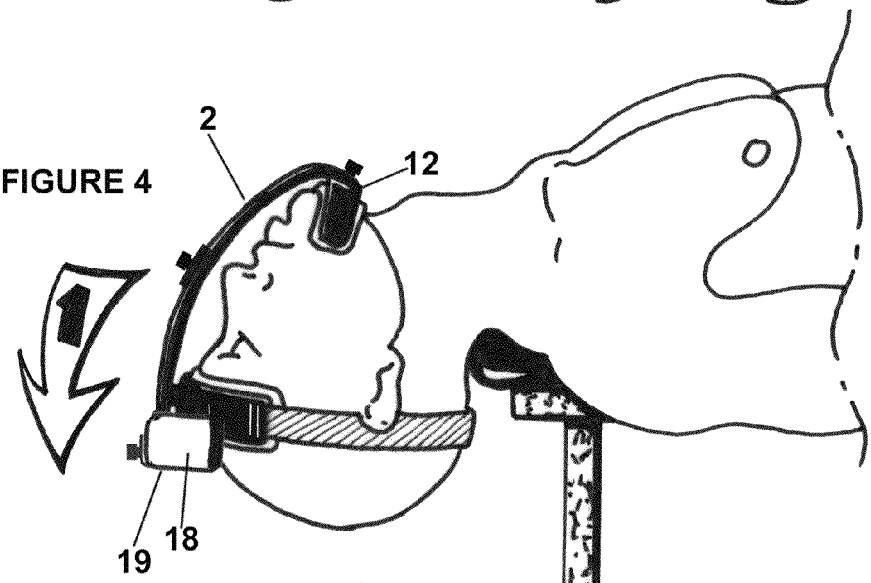
FIG. 4 illustrates a right-side lateral view of the present invention being worn by the user in the extension phase where the head is extending backwards.
Figure 5:
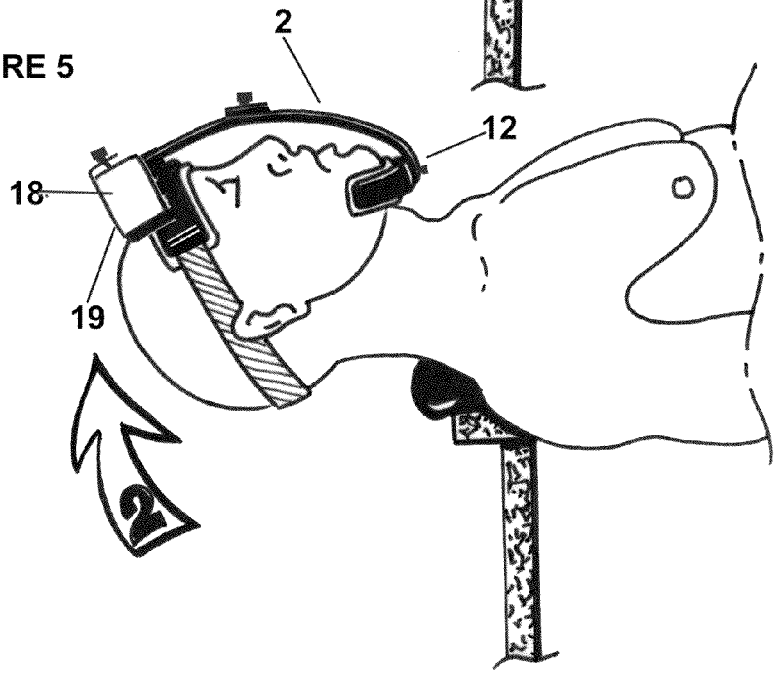
FIG. 5 illustrates a right-side lateral view of the present invention being worn by the user in the concentric or contraction phase where the head is rising effectuating the desired anterior cervical musculature.

As illustrated in FIG. 4, as the head descends, the weighted resistance (18) located above the forehead cross-member (1) traverses along the spine (2) coming to bear on the underside of the chin support (12) providing negative resistance. Conversely, as illustrated in FIG. 5, as the head rises, the same weight (18) provides positive resistance or flexion effectuating the anterior musculature including but not limited to, the sternocleidomastoid, scalene, platysma, sternohyoid, omohyoid, mylohyoid, scalene and stylohyoid. Repeating the aforementioned movements illustrated in FIGS. 4 and 5, the user will notice an improvement in flexibility and tone in the entire neck and can adjust the weight (18) to match their fitness and physical abilities.

The foregoing description of related art and preferred embodiment will assist those of ordinary skill in the pertinent art to make and use the invention without extensive experimentation.

The invention claimed is:

1. A portable and adjustable neck and lower mandible isotonic, weighted exercise and rehabilitative apparatus comprising:

A. a raised, two-part longitudinal spine adapted to be secured to a user's head, the longitudinal spine comprised of a female receiver and a raised longitudinal male counterpart adjustably placed within the female receiver;

B. a latitudinal forehead support permanently affixed to the longitudinal spine;

C. an adjustable chin support that slides along the longitudinal spine and a fastener that secures the chin support to the longitudinal spine;

D. a strap adjustably attached to the forehead support, the strap stabilizing lateral movement of the device and adapted to firmly secure the device to a user's head, ensuring the user's safety and the device's stability;

E. a centrally located receiver formed on the longitudinal spine adjacent the forehead support, the centrally located receiver having a slot or opening configured to receive one or more weights;

F. a locking mechanism which secures the one or more weights in the receiver; the locking mechanism configured to be opened to add or remove weights to achieve a desired weighted resistance.

2. A universally adjustable isotonic neck exercise or rehabilitative apparatus designed and implemented in accordance with claim 1 which when secured to the head and placed on the face affect toning and conditioning of the neck or facial musculature.

3. A universally adaptable isotonic neck exercise device designed and implemented in accordance with claim 1 which can be is adjusted to meet each user's unique physiological specifications.

* * * * *